US011453569B2

(12) United States Patent
Muller et al.

(10) Patent No.: US 11,453,569 B2
(45) Date of Patent: Sep. 27, 2022

(54) APPARATUS FOR USE IN A BLASTING SYSTEM

(71) Applicant: DETNET SOUTH AFRICA (PTY) LTD, Johannesburg (ZA)

(72) Inventors: Elmar Lennox Muller, Johannesburg (ZA); Michiel Jacobus Kruger, Johannesburg (ZA); Pierre De Vos Mynhardt, Johannesburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 1023 days.

(21) Appl. No.: 16/092,536

(22) PCT Filed: Apr. 7, 2017

(86) PCT No.: PCT/ZA2017/050020

§ 371 (c)(1),
(2) Date: Oct. 10, 2018

(87) PCT Pub. No.: WO2017/181207

PCT Pub. Date: Oct. 19, 2017

(65) Prior Publication Data

US 2019/0119066 A1 Apr. 25, 2019

(30) Foreign Application Priority Data

Apr. 11, 2016 (ZA) ..... 2016/02408

(51) Int. Cl.
*B65H 75/44* (2006.01)
*B65H 49/32* (2006.01)
(Continued)

(52) U.S. Cl.
CPC ..... *B65H 75/4484* (2013.01); *B65H 49/32* (2013.01); *F42D 1/043* (2013.01); *F42D 1/22* (2013.01)

(58) Field of Classification Search
CPC ..... B65H 75/4484; B65H 49/32; F42D 1/043; F42D 1/22
See application file for complete search history.

(56) References Cited

U.S. PATENT DOCUMENTS 2,021,632 A * 11/1935 Mathey ..... E21B 19/008 254/282
2,069,695 A * 2/1937 Brown ..... F42D 1/045 200/61.15

(Continued)

FOREIGN PATENT DOCUMENTS

CN 109238063 B * 5/2021 ..... F42D 3/04
EP 2472056 A1 7/2012

(Continued)

OTHER PUBLICATIONS

International Preliminary Report on Patentability for PCT/ZA2017/050020, international filing date of Apr. 7, 2017, dated Jul. 24, 2018, 16 pages.

(Continued)

*Primary Examiner* — Joshua T Semick
(74) *Attorney, Agent, or Firm* — Cantor Colburn LLP

(57) ABSTRACT

A spool for use in a blasting system which carries a coiled signal-transmitting conductor which is connected at one end to a detonator and at an opposed end to a connector.

6 Claims, 4 Drawing Sheets

(51) Int. Cl.
*F42D 1/22* (2006.01)
*F42D 1/04* (2006.01)

(56) References Cited

U.S. PATENT DOCUMENTS 2,089,981 A * 8/1937 Price ..... F42D 1/045 361/248
2,173,777 A * 9/1939 Eads ..... F42D 1/05 191/12.2 A
2,205,056 A * 6/1940 Atkins ..... H02G 11/02 200/561
2,267,845 A * 12/1941 Stephens ..... F42D 1/045 242/395
3,686,448 A * 8/1972 Brower ..... H02G 11/02 191/12 R
4,166,418 A * 9/1979 Calder, Jr. ..... F42D 1/06 102/275.3
7,086,335 B2 * 8/2006 O'Brien ..... F42D 1/043 86/1.1
8,261,663 B2 * 9/2012 Perez Cordova ..... F42B 3/122 102/206
10,557,693 B2 * 2/2020 Lerche ..... F42D 1/043
2004/0007911 A1 * 1/2004 Smith ..... F42D 1/12 299/13
2004/0102870 A1 5/2004 Andersen et al.
2004/0255810 A1 12/2004 O'Brien et al.
2005/0016370 A1 1/2005 O'Brien et al.

FOREIGN PATENT DOCUMENTS

GB 11517 A 1/1913
WO 2016086242 A2 6/2016
WO 2017181206 A1 10/2017
ZA 201404847 B 7/2015

OTHER PUBLICATIONS

International Search Report for PCT/ZA2017/050020, international filing date of Apr. 7, 2017, dated Sep. 6, 2017, 3 pages.
Written Opinion for PCT/ZA2017/050020, international filing date of Apr. 7, 2017, dated Sep. 6, 2017, 5 pages.

* cited by examiner

APPARATUS FOR USE IN A BLASTING SYSTEM

CROSS-REFERENCE TO RELATED APPLICATIONS

This application is a U.S. national stage application of International Application No. PCT/ZA2017/050020 entitled "APPARATUS FOR USE IN A BLASTING SYSTEM", which has an international filing date of 7 Apr. 2017, and which claims priority to South African Patent Application No. 2016/02408, filed 11 Apr. 2016.

BACKGROUND OF THE INVENTION

This invention relates to an apparatus for use in a blasting system and, more particularly, is concerned with an apparatus which includes an elongate flexible signal-transmitting conductor which, in use, is connected to a detonator.

A flexible signal-transmitting conductor such as a conductive wire, a fibre-optic cable, or a shock tube, is often provided, for use in a blasting system, in a compact form. Usually the conductor is coiled and is then shrink-wrapped. One end of the conductor is fixed to a detonator while an opposing end is connected to an appropriately designed connector. The connector is one of a plurality of similar connectors which are electrically or otherwise coupled to a harness or distribution system.

In use each detonator, suspended from the respective signal-transmitting conductor, is lowered into a respective borehole to a suitable depth. Thereafter an explosive composition, typically an emulsion, is placed into the borehole with the detonator and a length of the signal-transmitting conductor then being embedded in the explosive.

Although the described arrangement does function, generally, satisfactorily certain problems, which are associated with the arrangement, can arise. For example, care should be exercised when the signal-transmitting conductor is played out so that the coils do not become entangled one in the other. Another aspect is that it can be difficult to determine the depth to which a detonator has been lowered into a borehole. A further issue is that a tensile force which is exerted by the explosive on the conductor, due to a frictional interengagement of the explosive with the detonator, and with an outer surface of the conductor, can cause the conductor to extend until ultimately its tensile strength is exceeded and the conductor breaks.

It can also be difficult to establish the whereabouts of each detonator/conductor arrangement on a large blasting site. The connector which is coupled to the conductor has small physical dimensions and, depending on the terrain at which the blast site is established, it can take some time to locate the connector.

An object of the present invention is to provide an apparatus which, in one or more embodiments, can be used to address the aforementioned requirements at least to some extent.

SUMMARY OF THE INVENTION

The invention provides an apparatus for use in a blasting system which includes a spool with a hub, an elongate flexible signal-transmitting conductor which has a first end and a second end and which is coiled on the hub, at least a first detonator which is connected to the signal-transmitting conductor at or near the first end and a connector device which is connected or exposed to the signal-transmitting conductor at or near the second end.

The signal-transmitting conductor may be selected from the following: electrical leads, a fibre-optic cable, and a shock tube.

A second detonator may be connected to the signal-transmitting conductor at a location which is displaced from the first end.

The spool may include first and second spaced discs which are mounted to the hub thereby to contain the signal transmitting conductor in a coiled configuration on the hub between the discs.

The hub may be hollow and may be of a tubular configuration. The hub and the discs may be integrally moulded from a suitable plastics material.

The connector device may be separate from the spool or at least a part of the connector device may be integrally formed with the spool.

The connector device may take on different forms. In one embodiment the connector device is of the general kind described in the specification of international application No. PCT/ZA2015/050022. The content of the international specification is hereby incorporated wholly into this specification. Thus the connector device may include a housing and, mounted in or on the housing, a power source, a radio receiver, a radio transmitter, a processor/logic unit and terminals for connection to the at least one signal-transmitting conductor.

In an alternative arrangement any one or more of the aforementioned components, included in the connector device, are directly mounted to the spool, for example in a cavity which is formed in the spool, or in a housing which is associated directly or indirectly with the spool.

The apparatus may include a measuring device for producing a measure of a length of the signal-transmitting conductor, taken for example from the first detonator, which is uncoiled from the hub.

The measuring device may take on different forms. An electronic measuring device may be employed. The electronic device may be based on the provision of spaced apart markings on the signal-transmitting conductor which pass an appropriate sensor as the conductor is played out from the spool. In this way a count can be established of a length of the signal-transmitting conductor which is uncoiled from the spool.

In a different, mechanically-based arrangement, the signal-transmitting conductor includes enlarged formations which are provided for the purpose at spaced apart and regular intervals along a length of the signal-transmitting conductor. The passage of an enlarged formation past an appropriate sensor or detector e.g. a ratchet device, can be used to provide a mechanically derived count of a length of the signal-transmitting conductor which is uncoiled from the spool.

As indicated (in one embodiment) the signal-transmitting conductor is a shock tube. Ignition of the shock tube can be achieved, if desired, in the manner described in the specification of South African patent application No. 2014/04847. It thus falls within the scope of the invention for an induction heating process, which may be based on the use of components mounted to the spool, to be employed to cause ignition of the shock tube.

The apparatus may include at least one communication mechanism mounted on or otherwise forming part of the spool. The communication mechanism may include a transmitter, e.g. a light source or a radio source which, as required, is used to indicate the physical location of the spool.

The communication mechanism may be adapted to communicate, to transmit or otherwise to signify an identity which is uniquely associated with the apparatus or a part thereof such as the detonator.

The communication mechanism may be a two-way device in that it may be capable of receiving a signal transmitted from a remote point, e.g. a control location and, in response to the reception of such signal, of transmitting a suitable reply.

The spool may include a GPS. Alternatively a tagger, used to implement aspects of a blasting system, is used to read an identity number of the spool, and positional information of the spool—all used during a programming phase of a blasting sequence. A communication module on the spool may function in the nature of a passive transponder in that it draws energy from an interrogating signal on the tagger, to drive a transmitter which responds to the signal thereby to transmit information relating to the identity of the spool, its status, environmental data, and the like. This approach conserves energy contained in an on-board battery in the spool or the detonator. Infrared, near field communication or radio frequency techniques can, for example, be used for communication purpose with signals being modulated as appropriate e.g. for discrimination purposes. The tagger can also be used to send a signal to a processor on the spool, thereby to switch a battery on the spool or detonator from an off-state, to an on-state (in which the detonator can be fired).

The tagger could be hand held or it could be carried by a movable device, preferably a remotely controlled device such as a drone (unmanned aerial vehicle).

The apparatus may include one or more sensors which are mounted to, or which otherwise are associated with, the spool. For example the apparatus may include one or more of a temperature sensor, a vibration sensor and a chemical sensor. The last-mentioned sensor may be chosen to detect molecules which are associated with explosives of the kind with which the apparatus is to be used.

Each sensor may be responsive to a respective parameter on the signal transmitting conductor, on the spool or at the location of the conductor or the spool.

The use of the sensors enables data on environmental and operative conditions to be detected, measured and recorded. The effect of the parameters on a blasting process can then be assessed and, if the effect is adverse, corrective action can be taken, at least to some extent.

The spool may include a surface which, when exposed to appropriate environmental conditions, can function as an energy harvesting unit. For example, the spool surface may include a photo-voltaic device which is responsive to sunlight and which is used to produce electrical energy, which is stored in an appropriate battery such as an organic or a flexible battery. The stored energy may be used for powering one or more functions of the apparatus.

A benefit of using the apparatus of the invention lies in the fact that the spool has a relatively large size compared to the size of a typical (prior art) connector used in a blasting system. This makes it possible to attach components to the spool which facilitate identifying the location of the spool and hence of the detonator which is attached to the signal-transmitting conductor which is coiled on the spool. Thus a light source such as an LED, or an alternative transmitter which works at a frequency other than light, can be used to transmit a signal to a control device. The signal conveys information, to the control device, related for example to the position of the blast hole, the status of a detonator installation at the blast hole, or the like. The invention is not limited in this way.

In a blasting system a plurality of similar spools could be employed with the spools being appropriately colour-coded to facilitate the establishment of the blasting system and the implementation of various steps in the use of the blasting system. For example (this is illustrative only and non-limiting), if a fault occurs at a particular blast hole, e.g. if a detonator or a detonator connection is faulty, then a signal can be transmitted by a transmitter on the spool to signify/notify the physical location of the spool. The signal can be a light signal, produced for example by an LED, or an RF signal. The provision of the type of capability is facilitated by the relatively large size of the spool.

In the establishment of a blasting system the detonator which is attached to the signal-transmitting conductor is located at a predetermined depth inside a borehole and, subsequently, the borehole is charged with an explosive. The explosive surrounds the conductor and frictionally interengages with an outer surface of the conductor. A substantial force, which is thereby applied to the conductor, can elongate or stretch the conductor, in the longitudinal direction of the borehole, moving away from ground level. The tensile force which is exerted on the conductor, in this way, can be sufficiently large to break the conductor.

The apparatus of the invention allows the aforementioned problem to be addressed, at least to some extent. If the tensile strength of the conductor is known then the apparatus may include a release mechanism such as a clutch, a brake or a similar device which permits a degree of rotation of the spool or movement of the conductor, as the tensile force exerted by an explosive acting on the conductor, in the borehole, increases above a predetermined level. The spool is then adapted to undergo a limited degree of rotation about an axis which extends through the hub, when the tensile force which is exerted on the conductor by the explosive, approaches the tensile strength of the conductor. In this way, the magnitude of the tensile force which can be exerted on the conductor is restricted. The likelihood of the conductor breaking is thus reduced.

According to a different aspect of the invention there is provided a connector of the kind described in the specification of international application No. PCT/ZA2015/050022 which is characterised in that the housing is in the form of a spool, and in that the signal-transmitting conductor is located, in a coiled form, on a hub of the spool.

BRIEF DESCRIPTION OF THE DRAWINGS

The invention is further described by way of examples with reference to the accompanying drawings in which.

DESCRIPTION OF PREFERRED EMBODIMENTS

Figure 1:
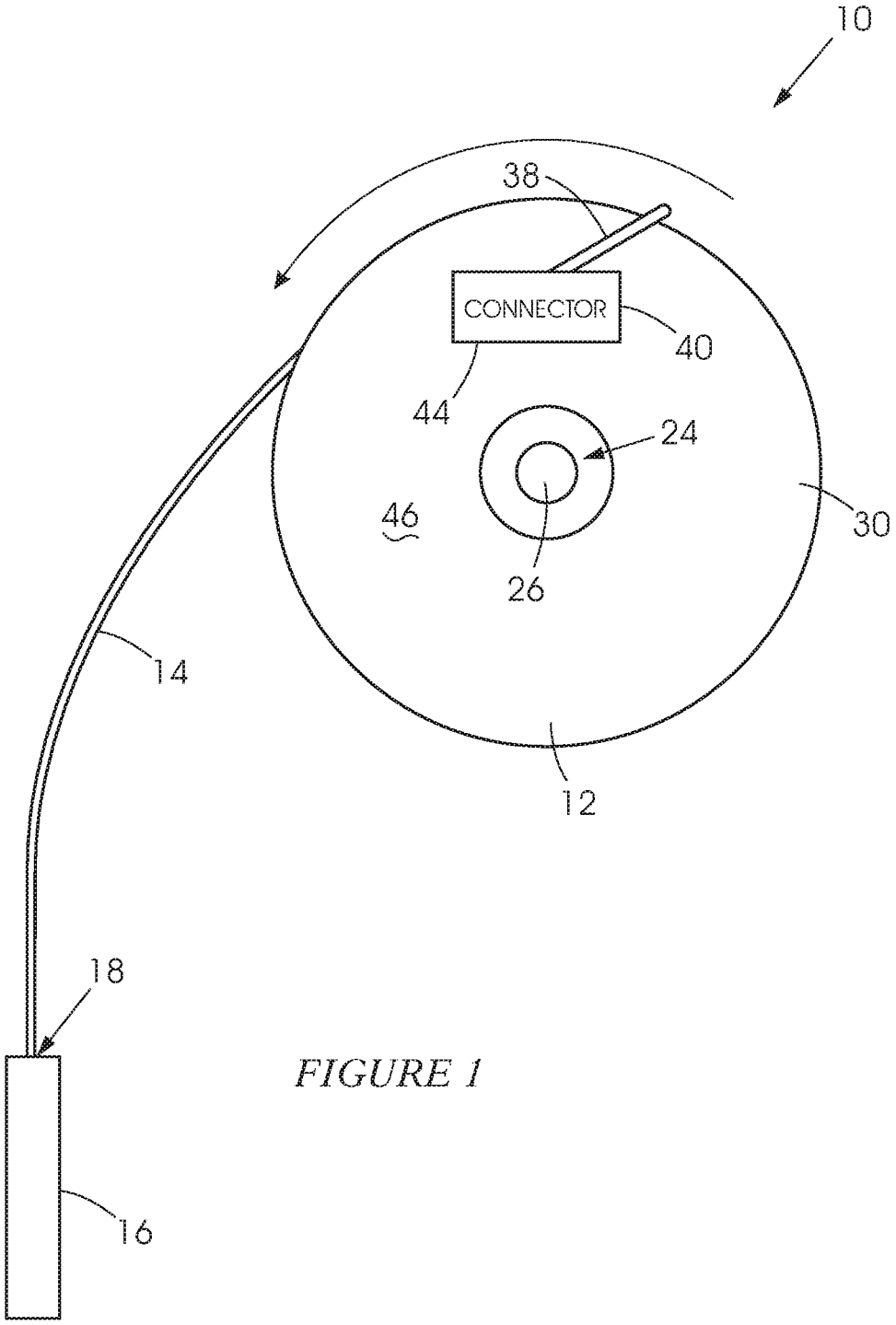
FIG. 1 is a side view of an apparatus according to a first form of the invention.

FIG. 1 of the accompanying drawings illustrates an apparatus 10 according to the invention. The apparatus includes a spool 12 on which is coiled an elongate, signal-transmitting conductor 14. By way of example the signal-transmitting conductor could be an electrical wire or a number of electrical wires, a shock tube, a fibre-optic cable or the like. A requirement in this respect is that the signal-transmitting conductor should be capable of transmitting a signal to a detonator 16 which is connected to the conductor at or close to a first end 18 of the conductor.

The spool includes a hub 24 with a centrally positioned passage 26. Two discs 28 and 30 are spaced apart from each other and are fixed to the hub. The discs bound an annular space 34 within which the conductor 14 is coiled.

Referring again to FIG. 1 a second end 38 of the conductor 14 is coupled to a connector 40 which, preferably, is of the type described in the specification of international application No. PCT/ZA2015/050022. This connector (see FIG. 2 as well) includes a power source 54, a radio transmitter/radio receiver module 52, a processor/logic unit 56 and terminals 68 which are mounted in or to a housing 44 which, preferably, is flush with an outer surface 46 of one of the discs 28, 30.

In use of the apparatus 10 the spool which is preferably integrally moulded from a suitable inexpensive plastics material is transported to a site of use and the detonator 16, suspended from the conductor 14, is then lowered into a borehole (not shown) to a desired depth. Thereafter the borehole is charged with an explosive material.

The connector 40 is coupled to a bus on the surface which is also connected to a control device, as is known in the art. Alternatively the connector 40 can be used to establish wireless communication, i.e. without physical conductive links, with the control device—again using techniques which are known in the art.

An advantage of using the apparatus 10 is that the coiled conductor 14 is kept at all times in a neat and tidy configuration on the hub. The likelihood that winding of the conductor which is deployed from the hub upon rotation of the spool, can become entangled with one another, is much reduced.

Figure 2:
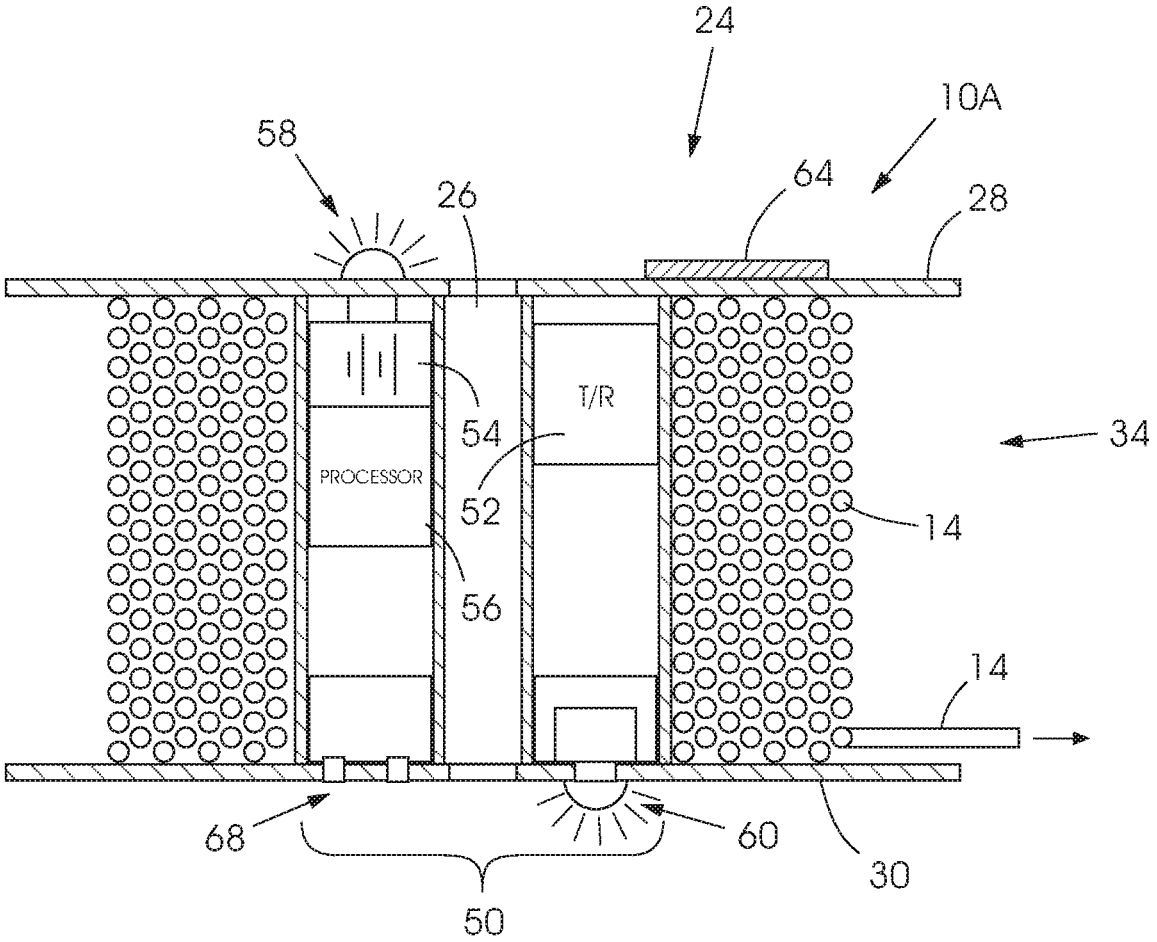
FIG. 2 depicts in cross-section an apparatus according to a variation of the invention.

FIG. 2 illustrates an apparatus 10A, in cross-section, which comprises a variation of the arrangement shown in FIG. 1. A detonator, not shown, is connected to an end of a signal-transmitting conductor 14 which is coiled on the hub 24. The hub is enlarged in that it defines an annular cylindrical cavity 50 in which components, corresponding to those listed in connection with the connector 40, are mounted. Thus the tubular hub contains a transmitter/receiver module 52, a battery 54 and a processor 56. Two light emitting devices, e.g. LED's, 58 and 60 which are mounted to the discs 28 and 30 respectively can be powered under controlled conditions by energy drawn from the battery 54. Optionally, a photo-voltaic cell 64 which is mounted to one of the discs is used to recharge the battery 54, when the cell is exposed to sunlight conditions.

Connector formations 68 are provided on one of the discs. These connector formations duplicate connector formations which are provided on the connector 40. In essence therefore the connector 40 which is shown in FIG. 1 is wholly mounted to the spool 12. Additionally the light-emitting diodes 58 and 60 mounted to the discs are coupled to the connector components.

In a broad sense the apparatus 10A is used in the same way as the apparatus 10 in that the conductor 14 is deployed from the spool to a required length as may be necessary to position a detonator, which is attached to the connector, at a desired position inside a borehole. During this process a short axle (not shown) placed through the passage 26 allows the spool to be rotated thereby to facilitate uncoiling of the conductor. Connections in the blasting system are then made via the formations 68.

If the apparatus 10A is interrogated from a remote control location then the light-emitting diodes 58 and 60 can be caused to pulse so that physical indications are given of the location of the spool. Alternatively or additionally a radio signal can be transmitted so that the spool can easily be located. This radio signal can also carry identity data pertaining at least to the detonator which is attached to the conductor.

Figure 3:
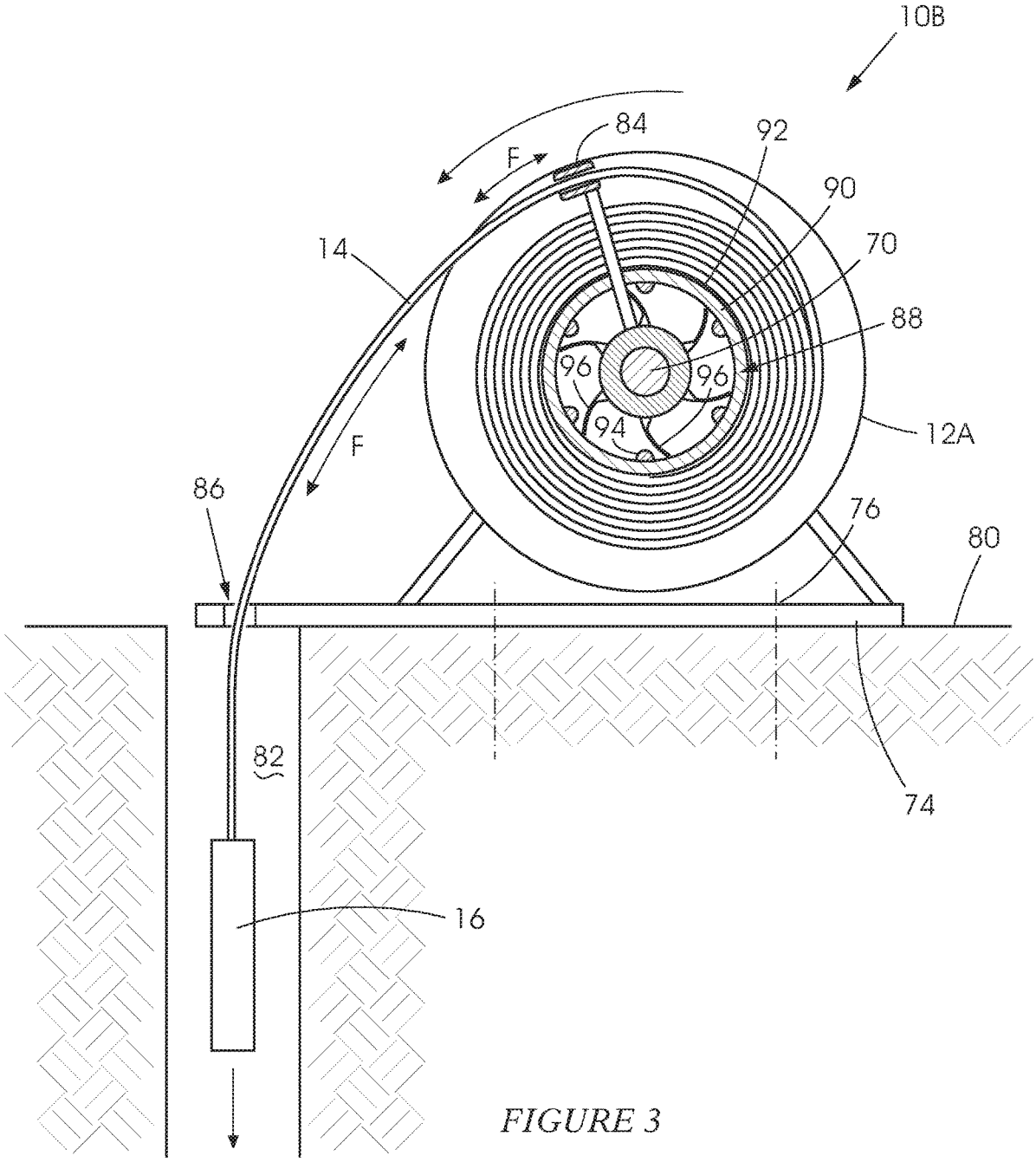
FIG. 3 is a side view, partly sectioned, of an apparatus according to another form of the invention.

FIG. 3 illustrates a variation 10B of the apparatus of the invention. A spool 12A is mounted for rotation about an axle 70 which in turn is supported on a stand 74 which is fixed, using suitable fasteners 76, to the ground 80 adjacent a borehole 82. The conductor 14 passes through a guide 84 which is mounted to the stand 74. A further guide 86 is used to position the conductor correctly in relation to the borehole 82. When the detonator 16 is at a desired depth inside the borehole explosive material, not shown, is placed into the borehole to cover the detonator and that portion of the conductor 14 which is inside the borehole. As explained in the preamble hereof frictional and loading forces exerted by the explosive on the conductor and directly on the detonator can cause the conductor to elongate in a longitudinal direction of the borehole. The tensile forces can be so great that the tensile strength of the conductor is exceeded and, in this event, the conductor breaks. To reduce the likelihood of this unfortunate event occurring the apparatus 10B includes an annular, centrally located, cylindrical cavity 90 which has a number of inwardly directed formations 94 on an inner surface. The axle 70 has a number of flexible or resilient leaves 96 which are brought into contact with the various formations 94. The arrangement is such that the leaves prevent free rotation of the cavity 90 about the axle 26. However, when the explosive exerts a tensile force F on the conductor and detonator, and the magnitude of the force F approaches the ultimate tensile strength of the conductor, the flexible leaves are deflected, automatically, by the formations 94 and a degree of rotation of the spool takes place which causes the tensile force in the conductor to be reduced. If the tensile force increases then the release mechanism again functions and the spool can rotate, in the manner described, through a limited arc to reduce the magnitude of the tensile force prevailing in the conductor.

Figure 4:
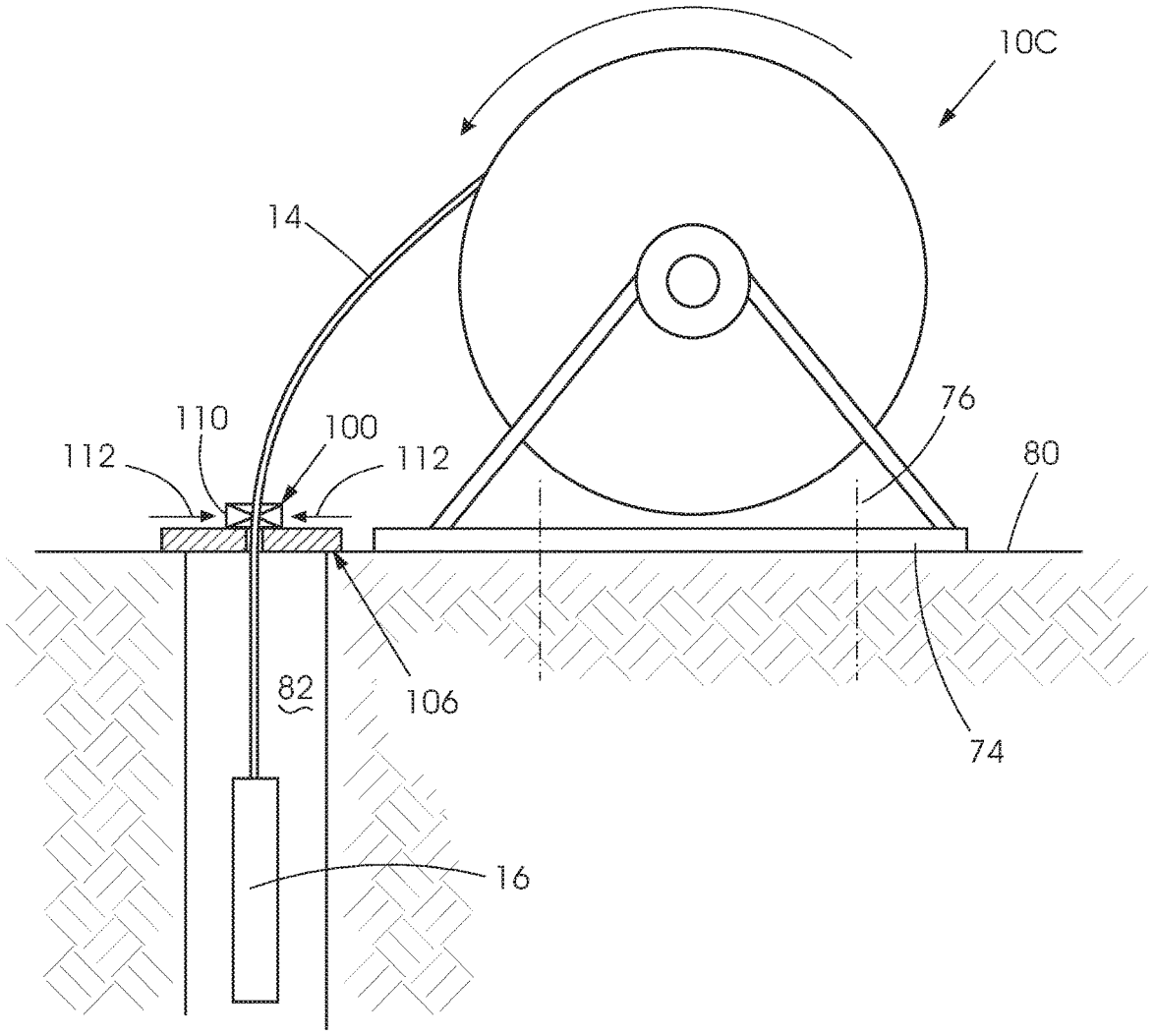
FIG. 4 is similar to FIG. 3 illustrating an apparatus according to a different form of the invention.

FIG. 4 shows an apparatus 100 which bears a number of similarities to the apparatus 10B. However the release mechanism 88 is replaced by a movement-restricting device 100 which, in this example, is mounted on the ground at a mouth of the borehole 82. The device 100 can take on different forms and conveniently comprises a plate 106 with a compressible friction component 110 mounted to the plate. The conductor 14 passes through a hole in the component 110 and in the plate 106. If the component 110 is compressed in a radial direction, as is indicated by arrows 112, then a frictional force is exerted on an outer surface of the conductor which tends to lock the conductor to the plate. The force is such that free movement of the conductor through the plate is inhibited. However if a tensile force is exerted on the conductor by the explosive in the hole then, once a limiting tensile force is reached, the frictional braking action of the component is exceeded and the conductor can move into the hole thereby to reduce the tensile force prevailing in the conductor.

The apparatus of the invention can also include a measuring device which facilitates a determination of a length of the conductor 14 which is placed into a borehole 82.

Figure 5:
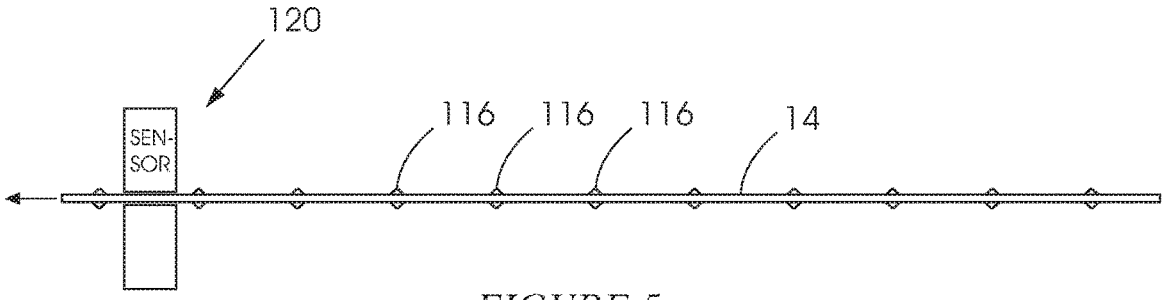
FIG. 5 depicts a portion of a signal-transmitting conductor which can be used in the apparatus of the invention.

Referring for example to FIG. 5 the conductor 14 can include a plurality of formations 116 at spaced apart and regular intervals. When the conductor is deployed from the spool (not shown) the formations pass a sensor 120 which detects, physically, the presence of the enlarged formations and a count is established of the number of formations which pass the sensor 120. The depth to which the detonator is placed into the borehole can then be assessed. In a variation of this idea the formations are replaced by markings on the conductor 14 and an optically based sensor 120 then detects the passage of the markings in a contactless manner which enables a count to be kept of the depth to which a detonator is placed in a borehole.

The invention claimed is:

1. An apparatus for use in a blasting system which includes a spool with a hub, first and second discs which are mounted to the hub, an elongate flexible signal-transmitting conductor which has a first end and a second end and which is coiled on the hub between the discs, at least a first detonator which is connected to the signal-transmitting conductor at or near the first end, a connector device which is connected or exposed to the signal-transmitting conductor at or near the second end, wherein the signal-transmitting conductor includes spaced-apart markings or formations and wherein the spool includes a sensor, responsive to passage of a marking or formation past the sensor to produce a measure of a length of the signal-transmitting conductor which is uncoiled from the hub and a release mechanism which, in use, permits a degree of rotation of the spool or movement of the conductor when a tensile force exerted on the conductor increases above a predetermined level, thereby to reduce the level of the tensile force exerted on the conductor characterised in that the connector device includes, wholly located inside the hub, a transmitter/receiver module, a battery and a processor and, on one of the discs, connector formations which are adapted to establish communication with a control device.

2. An apparatus according to claim 1 wherein the signal-transmitting conductor is selected from the following: electrical leads, a fibre-optic cable, and a shock tube.

3. An apparatus according to claim 1 which includes at least one light emitting device which is used to indicate the physical location of the spool.

4. An apparatus according to claim 1 wherein the transmitter/receiver module communicates an identity which is uniquely associated with the detonator.

5. An apparatus according to claim 1 wherein the transmitter/receiver module is capable of receiving a signal and, in response to the reception of such signal, of transmitting a reply.

6. An apparatus according to claim 1 which includes at least one sensor which is responsive at least to environmental or operative conditions including temperature, vibration, a specific chemical or chemicals.

* * * * *